US011060273B2

(12) United States Patent
Slaven, Jr. et al.

(10) Patent No.: US 11,060,273 B2
(45) **Date of Patent: *Jul. 13, 2021**

(54) LAMINATED BAMBOO PLATFORM AND CONCRETE COMPOSITE SLAB SYSTEM

(71) Applicant: Resource Fiber LLC, Homewood, AL (US)

(72) Inventors: Leland Slaven, Jr., Land O Lakes, FL (US); David Knight, Bainbridge Island, WA (US)

(73) Assignee: Resource Fiber, Homewood, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/723,612

(22) Filed: Dec. 20, 2019

(65) Prior Publication Data

US 2020/0123759 A1 Apr. 23, 2020

Related U.S. Application Data

(63) Continuation of application No. 16/226,340, filed on Dec. 19, 2018, now Pat. No. 10,597,863.

(Continued)

(51) Int. Cl.
*E04B 1/00* (2006.01)
*E04B 1/14* (2006.01)

(Continued)

(52) U.S. Cl.
CPC ..... *E04B 1/14* (2013.01); *E04B 1/043* (2013.01); *E04B 1/10* (2013.01); *E04B 1/41* (2013.01);

(Continued)

(58) Field of Classification Search
None
See application file for complete search history.

(56) References Cited

U.S. PATENT DOCUMENTS 221,720 A 11/1879 Colburn
1,913,864 A * 6/1933 Walper ..... B65D 67/02 206/453

(Continued)

FOREIGN PATENT DOCUMENTS

EP 2272667 A1 1/2011
GB 1157621 A 7/1969

(Continued)

OTHER PUBLICATIONS

International Searching Authority, International Search Report and Written Opinion, PCT Patent Application PCT/US2019/013713, dated Jun. 21, 2019, 10 pages.

(Continued)

*Primary Examiner* — Basil S Katcheves
(74) *Attorney, Agent, or Firm* — Perkins Coie LLP

(57) ABSTRACT

The present technology relates generally to a platform and concrete composite slab system used as a building material. A platform, is formed from joined, substantially coplanar boards with connector plates partially embedded between the boards such that a portion of the connector plates extend above the platform's top surface. A reinforcing material (e.g., wire mesh and/or rebar) can be arranged on the prongs or other portion of the connector plates spaced above the platform and concrete is poured over the reinforcing material and allowed to cure, forming a reinforced concrete layer that encases the connector plates and reinforcing material. The connector plates act as standoffs and help to suspend the reinforcing material in the middle of the concrete layer to increase the strength of the reinforced concrete and to fixedly anchor and bind the concrete layer to the platform, so as to establish a composite action between the platform and the concrete.

21 Claims, 12 Drawing Sheets

Related U.S. Application Data

(60) Provisional application No. 62/715,162, filed on Aug. 6, 2018, provisional application No. 62/619,615, filed on Jan. 19, 2018.

(51) Int. Cl.

| | |
|---|---|
| ***E04B 1/04*** | (2006.01) |
| ***E04B 1/10*** | (2006.01) |
| ***E04B 1/41*** | (2006.01) |
| ***E04B 5/23*** | (2006.01) |
| *E04B 1/38* | (2006.01) |

(52) U.S. Cl.

CPC ..... *E04B 5/23* (2013.01); *E04B 2001/405* (2013.01); *E04B 2005/237* (2013.01); *E04B 2103/02* (2013.01); *E04B 2103/04* (2013.01)

(56) References Cited

U.S. PATENT DOCUMENTS 2,037,573 A * 4/1936 Grant ..... E04C 5/07 52/250
2,723,693 A 11/1955 Hayashiguchi et al.
2,858,990 A 11/1958 Honeyman et al.
3,289,371 A * 12/1966 Pearson ..... B28B 19/0092 52/338
3,358,336 A 12/1967 Chaikin et al.
3,365,222 A * 1/1968 Polyak ..... E04B 1/2608 403/384
3,424,270 A * 1/1969 Hartman ..... C08L 2666/04 181/290
3,464,877 A 9/1969 Miller et al.
3,503,833 A * 3/1970 Carlson ..... E04C 2/12 428/56
3,605,360 A * 9/1971 Lindal ..... B32B 15/10 52/223.8
3,857,217 A * 12/1974 Reps ..... B32B 5/024 52/592.1
4,134,440 A 1/1979 Kawawa et al.
4,137,685 A 2/1979 Fang et al.
4,195,713 A * 4/1980 Hagbjer ..... B32B 7/02 188/268
4,774,121 A 9/1988 Vollenweider
4,799,961 A 1/1989 Friberg
4,810,551 A 3/1989 Chu
4,857,145 A 8/1989 Villavicencio
4,924,648 A * 5/1990 Gilb ..... E04B 1/41 52/295
4,932,178 A * 6/1990 Mozingo ..... E01D 2/00 52/223.7
4,985,119 A 1/1991 Vinson et al.
5,030,289 A 7/1991 Sattler et al.
5,047,086 A 9/1991 Hayakawa et al.
5,048,581 A 9/1991 Pierson et al.
5,150,553 A * 9/1992 Commins ..... E04B 1/0007 52/264
5,151,238 A 9/1992 Earl et al.
5,161,591 A 11/1992 Sealey et al.
5,167,710 A 12/1992 Leroux et al.
5,196,061 A 3/1993 Thomas et al.
5,271,996 A 12/1993 Tanabe et al.
5,397,067 A 3/1995 Akiyama et al.
5,415,821 A 5/1995 Irie et al.
5,441,787 A 8/1995 Fujii et al.
5,456,964 A 10/1995 Tamura et al.
5,505,238 A 4/1996 Fujii et al.
5,543,197 A 8/1996 Plaehn
5,561,957 A 10/1996 Gauthier
5,573,348 A 11/1996 Morgan
5,679,191 A 10/1997 Robinson et al.
5,733,671 A 3/1998 Bayasi
5,738,924 A 4/1998 Sing
5,741,589 A 4/1998 Fujii et al.
5,759,463 A 6/1998 Chang
5,786,063 A 7/1998 Shibusawa et al.
5,813,182 A * 9/1998 Commins ..... E02D 27/01 52/295
5,814,170 A 9/1998 Shibusawa et al.
5,876,649 A 3/1999 Ryan
5,881,460 A 3/1999 Nowell et al.
5,882,745 A 3/1999 Mi et al.
5,972,467 A 10/1999 Washo et al.
5,976,644 A 11/1999 Sanaee et al.
5,980,672 A 11/1999 Ryan
6,010,585 A * 1/2000 Fujii ..... B28B 1/525 156/510
6,015,107 A 1/2000 Stegmeier
6,086,804 A 7/2000 Akiyama et al.
6,098,680 A 8/2000 Nien et al.
6,180,211 B1 1/2001 Held
6,197,414 B1 3/2001 Kawai et al.
6,256,949 B1 * 7/2001 Meierhofer ..... E04C 2/14 52/223.1
6,281,148 B1 8/2001 Dagher et al.
6,383,652 B1 5/2002 Templeton et al.
6,391,435 B1 5/2002 Akiyama et al.
6,513,290 B2 * 2/2003 Leek ..... E04B 1/2604 52/295
6,513,292 B2 2/2003 Kumon
6,564,837 B1 5/2003 Lou
6,576,331 B1 * 6/2003 Ryan ..... B27N 5/00 428/297.4
6,641,885 B2 11/2003 Lou
6,689,298 B2 2/2004 Yoshida
6,722,093 B2 * 4/2004 Dauplay ..... B32B 9/02 52/313
6,737,006 B2 5/2004 Grohman
6,773,500 B1 8/2004 Creamer et al.
6,841,231 B1 1/2005 Liang et al.
6,872,246 B2 3/2005 Merkley et al.
6,875,503 B1 4/2005 Famy et al.
6,929,841 B1 8/2005 Van Dijk et al.
6,976,345 B2 12/2005 Keshmiri
7,021,879 B2 * 4/2006 Taneichi ..... F16B 15/0046 411/466
7,147,745 B1 12/2006 Slaven et al.
7,152,379 B2 * 12/2006 Lin ..... B32B 3/10 52/403.1
7,160,053 B2 * 1/2007 Chang ..... B27J 1/003 404/35
7,166,181 B2 1/2007 Cable
7,172,136 B2 2/2007 Leon
7,225,591 B2 * 6/2007 Lin ..... B32B 3/10 52/403.1
7,276,551 B2 10/2007 Pageau
7,537,031 B2 5/2009 Jarck
7,785,681 B2 8/2010 Liao
7,908,808 B2 * 3/2011 Hundegger ..... E04F 13/10 52/311.3
7,914,637 B2 3/2011 Pedoja
7,939,156 B1 5/2011 Slaven et al.
8,075,735 B2 12/2011 Jarck
8,173,236 B1 5/2012 McDonald
8,231,757 B2 * 7/2012 Lin ..... B32B 9/02 156/256
8,245,742 B2 8/2012 Filion et al.
8,268,430 B2 9/2012 Johnson et al.
8,561,373 B1 10/2013 McDonald et al.
8,667,744 B2 * 3/2014 Shaw ..... E04F 15/04 52/97
8,672,600 B2 * 3/2014 Reznar ..... E04F 15/04 411/457
8,776,316 B2 7/2014 Mcroskey et al.
9,937,685 B2 4/2018 Slaven et al.
10,087,630 B2 10/2018 Hebei et al.
10,266,987 B2 4/2019 Slaven et al.
10,597,863 B2 * 3/2020 Slaven, Jr. ..... E04B 1/41
2002/0095897 A1 * 7/2002 Summerford ..... E04F 15/02 52/489.1
2003/0009980 A1 * 1/2003 Shahnazarian ..... E04C 3/36 52/712
2003/0079804 A1 5/2003 Hsu

(56) References Cited

U.S. PATENT DOCUMENTS

| | | | | |
|---|---|---|---|---|
| 2003/0207098 | A1 | 11/2003 | Ryan | |
| 2004/0191448 | A1 | 9/2004 | Wu | |
| 2005/0048273 | A1 | 3/2005 | Ryan | |
| 2005/0087904 | A1 | 4/2005 | Bryan | |
| 2005/0161852 | A1 | 7/2005 | Decker et al. | |
| 2005/0163990 | A1 | 7/2005 | Chang | |
| 2005/0173089 | A1 | 8/2005 | Liang et al. | |
| 2008/0023868 | A1 | 1/2008 | Slaven et al. | |
| 2010/0178451 | A1 | 7/2010 | Li | |
| 2013/0210309 | A1 | 8/2013 | Kim et al. | |
| 2014/0000761 | A1 | 1/2014 | Peng | |
| 2014/0208688 | A1* | 7/2014 | Vitullo | E04B 1/41 52/782.1 |
| 2015/0129698 | A1 | 5/2015 | Olson et al. | |
| 2015/0158263 | A1 | 6/2015 | Maddala et al. | |
| 2015/0197069 | A1 | 7/2015 | Basquin et al. | |
| 2015/0197396 | A1 | 7/2015 | Simons et al. | |
| 2015/0275428 | A1 | 10/2015 | Slaven et al. | |
| 2017/0030089 | A1* | 2/2017 | Zhang | E04F 15/048 |
| 2017/0260755 | A1 | 9/2017 | Sherstad et al. | |
| 2017/0299198 | A1 | 10/2017 | Collins et al. | |
| 2017/0356193 | A1 | 12/2017 | Song et al. | |
| 2018/0010298 | A1 | 1/2018 | Slaven et al. | |
| 2018/0299230 | A1 | 10/2018 | Slaven et al. | |
| 2018/0354562 | A1 | 12/2018 | Slaven et al. | |
| 2019/0226196 | A1 | 7/2019 | Slaven et al. | |

FOREIGN PATENT DOCUMENTS

| | | | |
|---|---|---|---|
| JP | 2000351160 | A | 12/2000 |
| JP | 4791437 | B2 | 7/2011 |
| WO | 2009146254 | A1 | 12/2009 |

OTHER PUBLICATIONS

International Searching Authority, International Search Report and Written Opinion, PCT Patent Application PCT/US2019/025550, dated Jun. 26, 2019, 12 pages.

* cited by examiner

LAMINATED BAMBOO PLATFORM AND CONCRETE COMPOSITE SLAB SYSTEM

CROSS-REFERENCE TO RELATED APPLICATIONS

This non-provisional patent application is a continuation of U.S. patent application Ser. No. 16/226,340, titled "LAMINATED BAMBOO PLATFORM AND CONCRETE COMPOSITE SLAB SYSTEM" and filed Dec. 19, 2018, which claims the benefit of and priority to U.S. Provisional Patent Application No. 62/619,615, titled "LAMINATED BAMBOO PLATFORM AND CONCRETE COMPOSITE SLAB SYSTEM" and filed Jan. 19, 2018, and U.S. Provisional Patent Application No. 62/715,162, titled "LAMINATED BAMBOO PLATFORM AND CONCRETE COMPOSITE SLAB SYSTEM" and filed Aug. 6, 2018, all of which are incorporated herein in their entireties by reference thereto.

TECHNICAL FIELD

The present technology relates generally to building materials that include composite slabs made from fiber-based materials, such as bamboo, and concrete.

BACKGROUND

A common building style used during the construction of various structures involves the use of prefabricated wood panels. These wood panels typically include sheets of plywood and wood beams assembled together to form a desired shape that matches the design requirements of the structure. The panels are built in a manufacturing facility located away from the construction site and then transported to the construction site to be installed. In this way, construction time on location may be reduced as the wood panels can be prepared before construction of the structure begins. Furthermore, constructing the wood panels in a manufacturing facility may be more time and cost efficient than constructing the wood panels at the construction site. As a result, the total cost and time required to build a structure may be reduced when utilizing prefabricated wood panels when compared to more traditional building techniques.

However, wood typically lacks the strength required to support larger structures. As such, reinforced concrete is often used as the primary building material for large building structures. The concrete is typically poured into a mold prepared at the construction site and allowed to cure on site. After curing, the mold is removed and the next portion of concrete is poured. However, concrete is significantly heavier than wood and can increase the weight of the building, requiring expensive structural and foundational systems to support the weight of the building. Further, concrete is typically brittle and tends to crack when deformed. When subjected to high wind or seismic activity that can cause the concrete to bend, the concrete tends to fail, losing the desired strength properties, potentially reducing the structural safety of the building. Some conventional construction systems reduce the amount of concrete by providing a metal decking with a thinner concrete top slab atop the metal deck. While this construction with the concrete topper can reduce the weight of the structure, the metal decking can be expensive, which adds to the final cost of the building structure. The metal decking with the concrete topper has other drawbacks and shortcomings.

To utilize the modularity and savings benefits of the prefabricated wood panels and the strength of the reinforced concrete, it would be desirable to provide an improved composite building material that incorporates concrete integrally supported and anchored on a non-concrete platform.

DETAILED DESCRIPTION

The present technology is directed to an engineered wood board apparatus and associated systems. Several embodiments of the present technology are related to engineered fiber-based boards formed from a fiber-based laminated board layer and a layer of concrete or other flowable/curable material, formed atop the laminated board layer. The fiber-based laminated board layer discussed below is a natural fiber-based laminated board comprising bamboo boards laminated together to form bamboo boards, although other natural fiber materials, such as fibrous grass-based materials, wood, or a combination of such materials could be used. Other fiber materials can be used in the laminated board layer that provide the suitable performance characteristics for use in the present technology. Specific details of the present technology are described herein with reference to FIGS. 1-15. Although many of the embodiments are described with respect to engineered natural fiber-based board apparatuses and systems, it should be noted that other applications and embodiments in addition to those disclosed herein are within the scope of the present technology. Further, embodiments of the present technology can have different configurations, components, and/or procedures than those shown or described herein. Moreover, a person of ordinary skill in the art will understand that embodiments of the present technology can have configurations, components, and/or procedures in addition to those shown or described herein and that these and other embodiments can be without several of the configurations, components, and/or procedures shown or described herein without deviating from the present technology.

Figure 1:
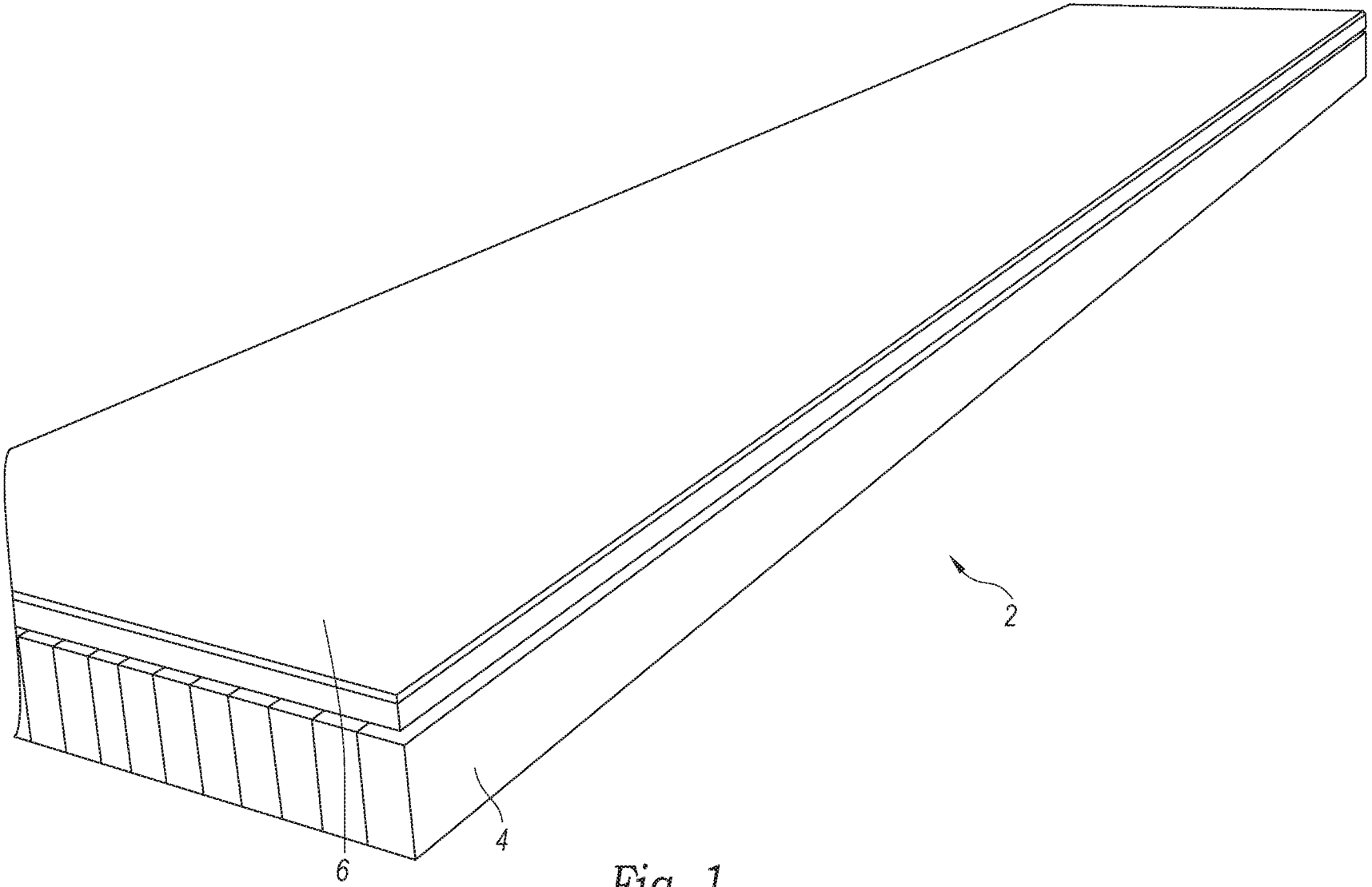
FIG. 1 is an isometric view of a laminated bamboo platform and concrete composite slab configured in accordance with one or more embodiments of the present technology.

FIG. 1 illustrates a bamboo and concrete composite slab 2 configured in accordance with the present technology. The slab 2 includes a bamboo layer 3 formed from one or more laminated bamboo platforms 4, and a reinforced concrete layer 6 is formed atop the bamboo layer 3. The bamboo platform 4 of the illustrated embodiment can be pre-manufactured, shipped to a selected construction site, and positioned in a desired location to receive a layer of concrete or other curable and/or slurry-based material, which is poured over the bamboo platform 4 and allowed to cure. Rebar or other reinforcing material can be supported on the laminated bamboo platform and encased or otherwise incorporated into the concrete. As the composite slab 2 is formed from a composite of bamboo and reinforced concrete, as discussed in greater detail below, the slab 2 incorporates the properties of both of the components. For example, using bamboo reduces the amount of concrete required to form the slab 2, resulting in the composite slab 2 weighing less than that of a similarly-sized slab composed entirely of reinforced concrete. Further, the strength of the composite slab is substantially equal to or greater than that of a concrete slab alone while retaining the flexural properties of the bamboo, thereby reducing likelihood of failure of the composite slab due to deformation. In addition, bamboo is more environmentally sustainable to produce, has greater fire resistive properties, and improved strength and stiffness properties in comparison to more traditional types of timber.

Figure 2A:
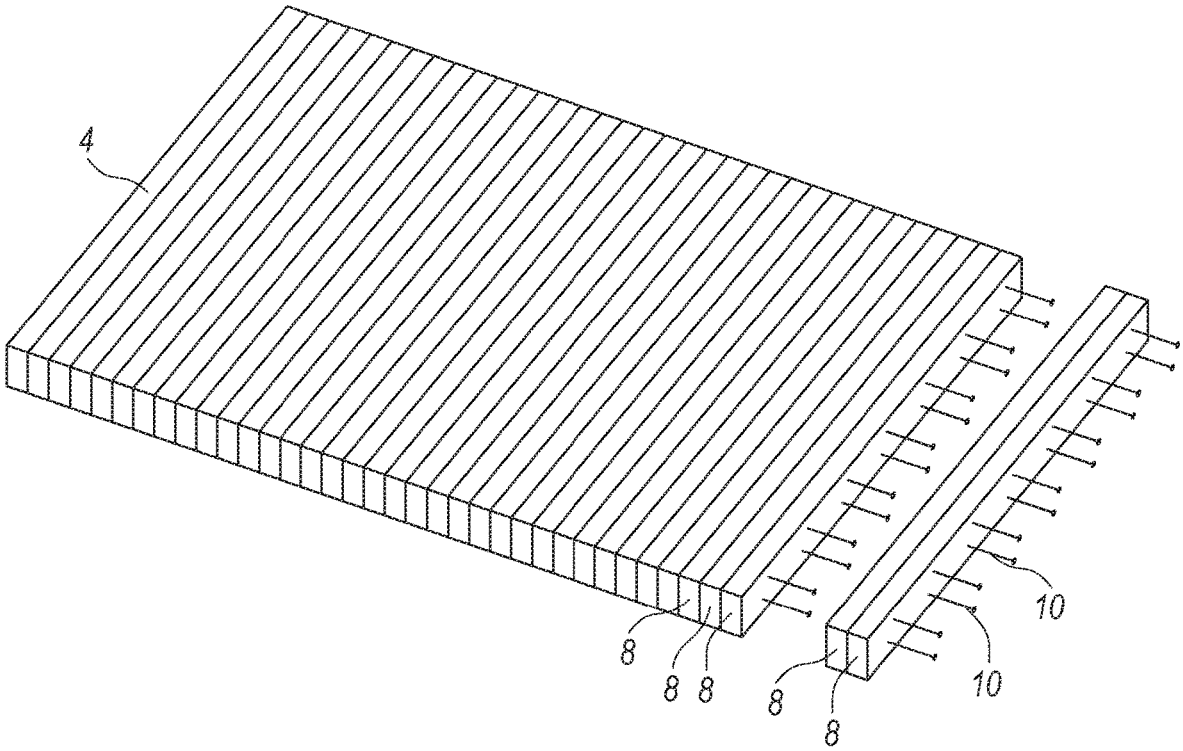
FIG. 2A is an isometric view of a laminated bamboo platform configured in accordance with embodiments of the present technology.
Figure 2B:
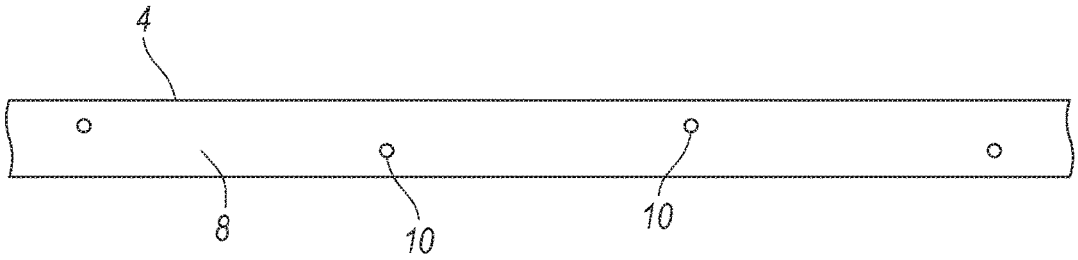
FIG. 2B is a side elevation view of the laminated bamboo platform.

FIGS. 2A and 2B illustrate a laminated bamboo platform 4 formed from a plurality of interconnected bamboo boards 8. Each of the bamboo boards 8 is formed from processed bamboo culms as disclosed in U.S. patent application Ser. No. 11/352,821, filed Feb. 13, 2006 and titled "Bamboo Beam and Process" and issued as U.S. Pat. No. 7,147,745, U.S. patent application Ser. No. 12/489,182, filed Jun. 22, 2009 and titled "Composite Concrete/Bamboo Structure" and issued as U.S. Pat. No. 7,939,156, U.S. patent application Ser. No. 14/673,659, filed Mar. 30, 2015 and titled "APPARATUS AND METHOD FOR PROCESSING BAMBOO OR VEGETABLE CANE," U.S. patent application Ser. No. 15/147,765, filed May 5, 2016 and titled "INDUSTRIAL PRODUCTS ENGINEERED FROM PROCESSED BAMBOO OR VEGETABLE CANE," and U.S. Provisional Patent Application No. 62/516,591, filed Jun. 7, 2017 and titled "BAMBOO AND OR VEGETABLE CANE COMPOSITE DECKING-PLANKING AND PROCESS," each of which is incorporated herein in its entirety by reference.

After the bamboo boards 8 are formed, the boards 8 are arranged parallel to one another forming stack and securely fastened to each other using a securing means, thereby forming the bamboo platform 4. In the embodiments shown in FIGS. 2A and 2B, the securing means includes a plurality of nails 10 or other fasteners driven into the boards 8 and that extend at least into an adjacent board 8. The nails 10 are spaced apart along the length of each of the boards 8 such that the boards 8 are secured together along their entire length. In the embodiment shown in FIG. 2A, nails 10 are driven into the boards 8 at each position along the length of each of the boards 8. In other embodiments, such as the embodiment shown in FIG. 2B, the nails 10 are staggered such that adjacent nails 10 inserted in a given board 8 have alternating vertical positions. In this way, conflict is avoided between nails 10 in adjacent boards 8. In the embodiments shown in FIGS. 2A and 2B, the securing means include nails 10. In other embodiments, however, the securing means may include screws or some other fastening mechanism. In still other embodiments, an adhesive, such as glue, epoxy resin or other adhesive, may be applied to the boards 8 in addition to or in lieu of the securing means to further ensure that the boards 8 remain securely fastened to each other.

Figure 3:
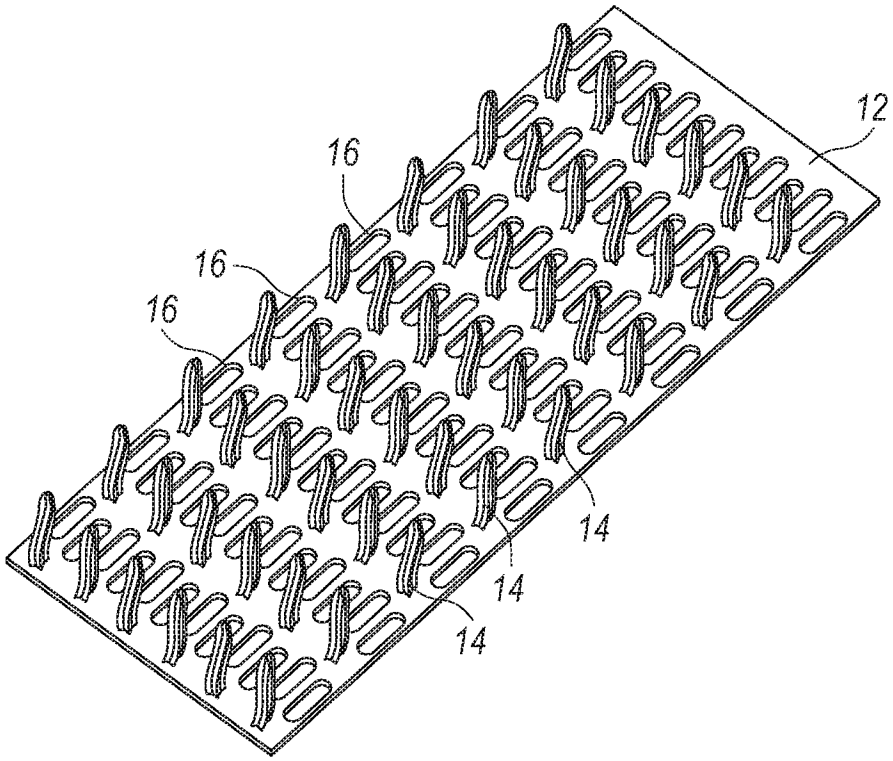
FIG. 3 is an isometric view of a connector plate configured in accordance with embodiments of the present technology.

To ensure that the reinforced concrete layer 6 remains securely coupled to the bamboo platform 4, the bamboo platform 4 also includes coupling fixtures that act as attachment and anchor points for the reinforced concrete layer 6. In some embodiments, the coupling fixtures are connector plates 12 (e.g., MiTek MT18 connector plates) at least partially embedded in the boards 8. FIG. 3 shows a sample connector plate 12 formed from a sheet of metal having an array of sharp, projecting prongs 14 punched out of a planar portion of the sheet to form an array of holes 16 in the sheet. The prongs 14 project away from the plate 12 and are generally perpendicular to the planar portion of the plate 12. During the manufacturing process of the bamboo platform 4, the connector plates 12 are secured to at least some of the boards 8 by embedding a portion of the plurality of prongs 14 projecting from a lower half or portion of each plate 12 into a selected bamboo board 8, such that a portion of the connector plate 12 projects upwardly above the top of the bamboo boards. When the multiple boards 8 are fastened together to form the substantially planar laminated bamboo platform 4 (e.g., using the nails 10, adhesive, etc.), the lower portions of the connector plates 12 are fixedly sandwiched and anchored between two adjacent boards 8. In other embodiments, nails or other connector rods can be embedded in bamboo boards 8 and project upwardly from the top surface of the bamboo platform 4 so as to act as a coupling fixture along with or instead of the connector plates 12.

As is well known in the art, reinforced concrete typically includes a reinforcing material (e.g., rebar, steel mesh, or other reinforcement material) embedded within the concrete material before the concrete cures. The reinforcing material, which preferably has a high relative strength and toleration of tensile strain, bonds to the concrete material and helps to counteract the concrete's relatively low tensile strength and ductility, thereby increasing the load-bearing capacity of concrete. The reinforcing material may also be stressed (e.g., via pre- or post-tensioning) to further improve the behavior of the reinforced concrete. In some arrangements, the reinforcing material is positioned over a desired location of the slab before the concrete is poured, preferably such that the reinforcing material will be centrally located within the slab.

After positioning the reinforcing material, the concrete is poured and left to harden and cure. However, if care is not taken, pouring the concrete may move the reinforcing material out of the center of the slab toward the bottom of the concrete. This may result in the top portion of the concrete slab being unreinforced as the reinforcing material is too low to significantly affect the mechanical properties of the concrete at the top. To prevent this from happening, the reinforcing material is typically securely held in place using anchor stakes and/or stand-offs. Rebar ties (or zip ties) may also be used to couple the reinforcing material to the anchor stakes/stand-offs to further ensure that the reinforcing material remains in place.

In the present technology, when the connector plates 12 are permanently captured between the laminated bamboo boards 8, the prongs 14 projecting from the lower portion of the connector plate 12 are embedded into the side of the bamboo board 8, while the upper portion of the connector plate remains exposed with the prongs 14 projecting generally parallel to the top surface of the respective bamboo board 8. As a result, the completed laminated bamboo platform 4 (e.g., a nail-laminated bamboo platform) includes the partially exposed connector plates 12, which have at least some exposed horizontally extending prongs 14. One or more bamboo platforms 4 can be positioned in a selected orientation, such as in a planar orientation at a construction site, and the reinforced concrete layer 6 is formed onto a top surface of the bamboo platform 4, such that the top portions of the connector plates 12 are encased within the concrete layer. A reinforcing material 18, such as rebar, wire mesh, or other reinforcing members, can be embedded within the concrete material above the laminated bamboo platform 4. In the illustrated embodiment, the connector plates 12 are configured to suspend the reinforcing material 18 above a top surface of the bamboo platform 4 to ensure that the reinforcing material 18 remains in position as the concrete is poured atop the laminated bamboo platform 4 and remains properly located within the concrete layer 6.

Figure 4:
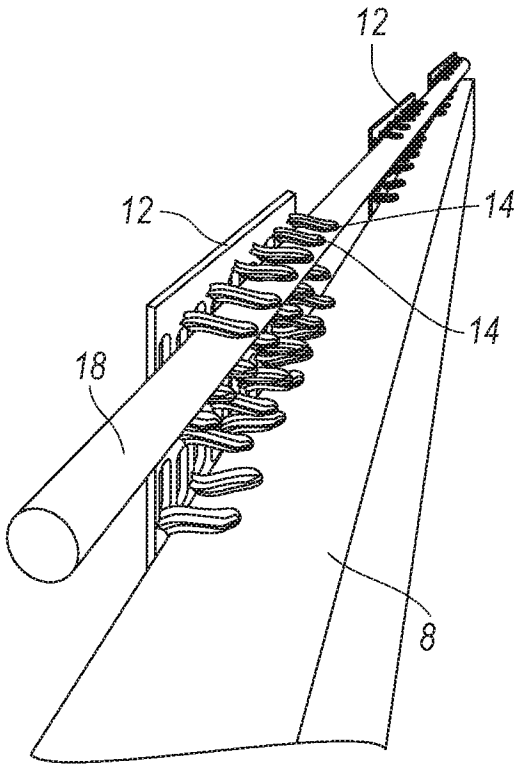
FIG. 4 is an isometric view of a portion of a laminated bamboo platform that includes a bamboo board, a connector plate, and a reinforcement material configured in accordance with embodiments of the present technology.

As shown in FIG. 4, the reinforcing material 18 includes rebar arranged on top of a row of prongs 14 projecting from aligned connector plates 12. The prongs 14 support and suspend the rebar above the top surface of the platform 4 to ensure that the concrete does not push the rebar downwards towards the surface of the platform 4. Clips, ties, zip ties, etc. may be used to couple the reinforcing material 18 to the plate 12 using three holes 16 (FIG. 3) to ensure that the reinforcing material 18 does not get dislodged from the plate 12 during the concrete pouring process. As a result, the plates 12 and prongs 14 act as stand-offs that prevent the undesired movement of the reinforcing material 18.

In the embodiment shown in FIG. 4, the reinforcing material 18 is resting on the second highest row of prongs 14 and is positioned below the top row of prongs 14. In this arrangement, the second row of prongs 14 prevents the reinforcing material 18 from being pushed downwards while the top row of prongs 14 prevents the rebar from being pushed upwards and becoming dislodged from the plate 12. In other embodiments, however, the reinforcing material 18 may be arranged on another row of prongs, such as the top row of prongs 14. In these embodiments, the top row of prongs 14 prevents the reinforcing material 18 from being pushed downwards while rebar ties or zip ties may be used to couple the reinforcing material 18 to the plates 12 to further prevent the reinforcing material 18 from being dislodged.

Figure 5:
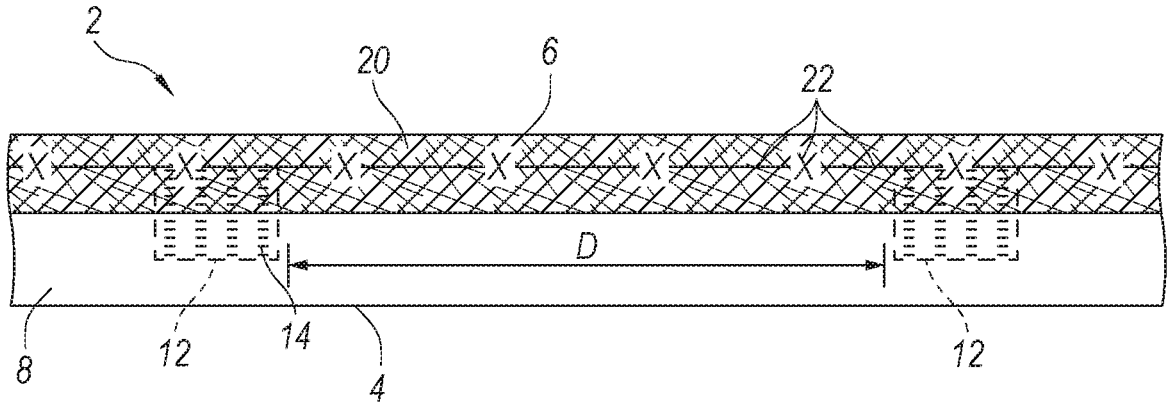
FIG. 5 is a cross-sectional side elevation view of the bamboo and concrete composite slab of FIG. 1.
Figure 6:
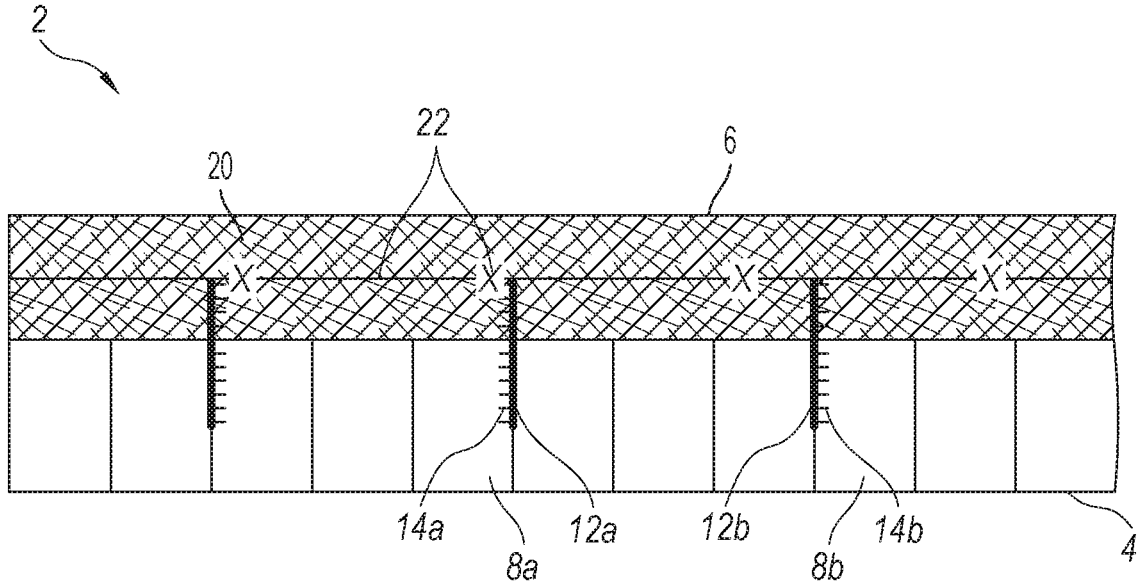
FIG. 6 is a cross-sectional side elevation view of the bamboo and concrete composite slab of FIG. 1.

In the embodiment shown in FIG. 4, the reinforcing material 18 includes pieces of rebar. In other embodiments, however, the reinforcing material 18 may be some other material. For example, FIGS. 5 and 6 show cross-sectional views of an embodiment of the bamboo and concrete composite slab 2 having a reinforcing material 18 formed from steel mesh 22 suspended in the layer 6 of concrete 20. The mesh 22 is formed from a grid-like pattern of generally perpendicular steel members that have openings sized and shaped to accommodate the connector plates 12. In FIGS. 5 and 6, the steel mesh 22 is configured to rest on top of the connector plates 12. In other embodiments, however, the mesh 22 is configured to be arranged between adjacent rows of prongs 14 in order to further restrict movement of the mesh 22. Although the illustrated embodiment shows the steel mesh 22, other mesh materials or other reinforcement material could be used.

As shown in FIG. 5, multiple connector plates 12 are coupled to a single board 8 in a substantially uniform pattern. The plates 12 are separated from each other by a distance D along the length of the board 8 and each of the plates 12 is coupled to a given board 8 and have a common orientation such that the prongs 14 on each of the plates 12 coupled to a board 8 point in the same general direction. However, plates 12 coupled to different boards 8 may have opposing orientations. For example, in the embodiment shown in FIG. 6, a first connector plate 12*a* has a first orientation such that the prongs 14*a* are embedded in the board 8*a* and pointed to the left while the second connector plate 12*b* has a second orientation where the prongs 14*b* are embedded in the board 8*b* and pointed to the right. As such, the adjacent first and second connector plates 12*a* and 12*b* have opposing orientations and the prongs 14*a* and 14*b* point in opposite directions. The bamboo platform 4 may include a plurality of the first connector plates 12*a* coupled to the bamboo board 8*a* and a plurality of the second connector plates 12*b* coupled to the bamboo board 8*b*, where each of the first connector plates 12*a* have the first orientation and each of the second connector plates 12*b* have the second orientation.

However, connector plates 12 may not be coupled to each board 8 in the bamboo platform 4. For example, in the embodiment shown in FIG. 6, the connector plates 12 are arranged such that the plates 12*a* and 12*b* are separated from each other by three boards 8 and no additional connector plates 12 are embedded in the boards 8 between plates 12*a* and 12*b*. Furthermore, the connector plates 12 are arranged such that prongs 14 on the plates 12 are embedded in just a third of the boards 8 in the bamboo platform 4 while the remaining boards 8 do not have any prongs 14 embedded in them. In other embodiments, however, the connector plates 12 may be arranged such that adjacent connector plates 12 are separated from each other by just a single board 8, by two boards 8, or by four or more boards 8.

Figure 7A:
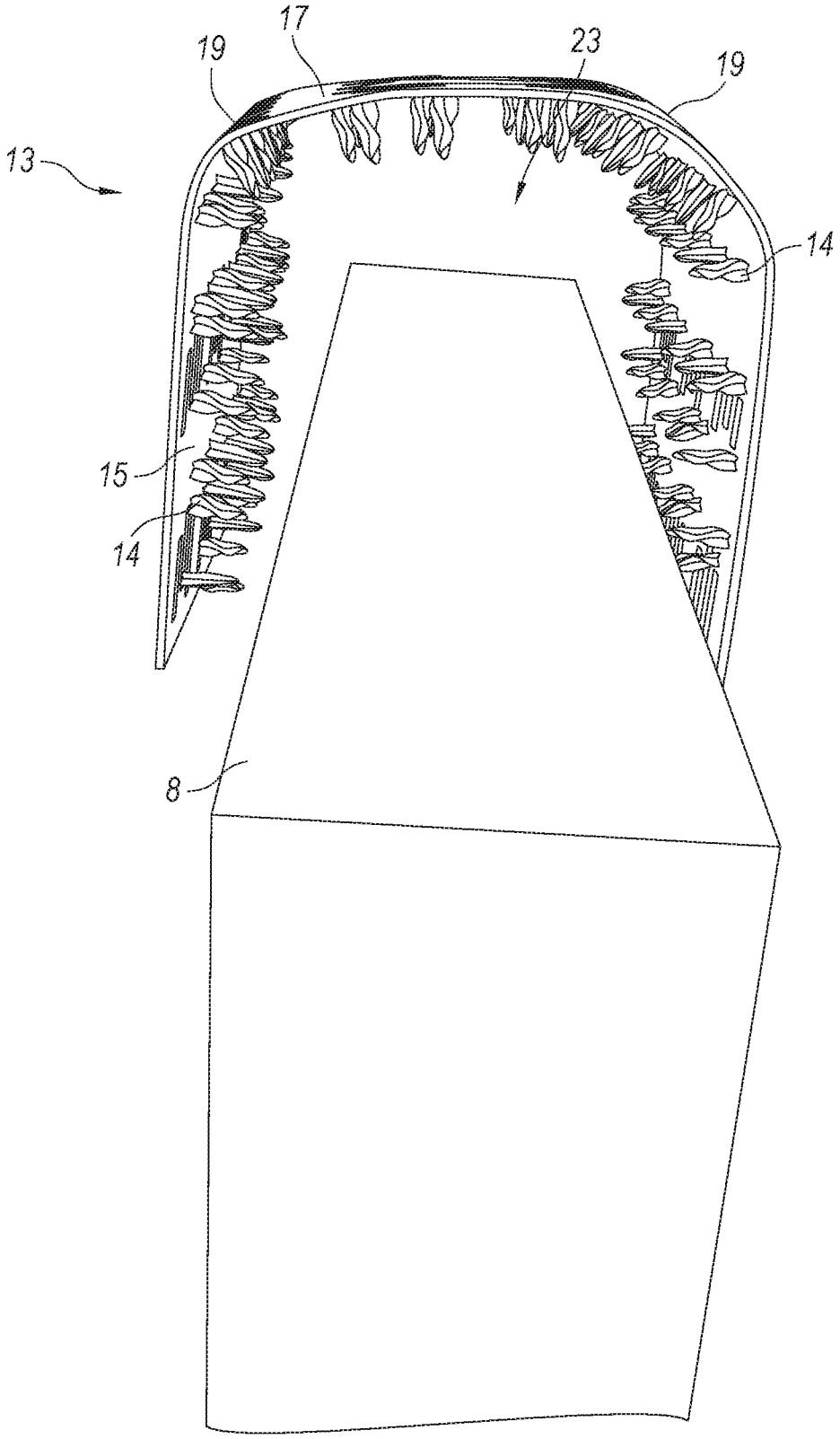
FIGS. 7A and 7B are isometric views of a connector bracket configured in accordance with embodiments of the present technology for secure attachment to either side or both sides of a bamboo board of the laminated bamboo platform.
Figure 7B:
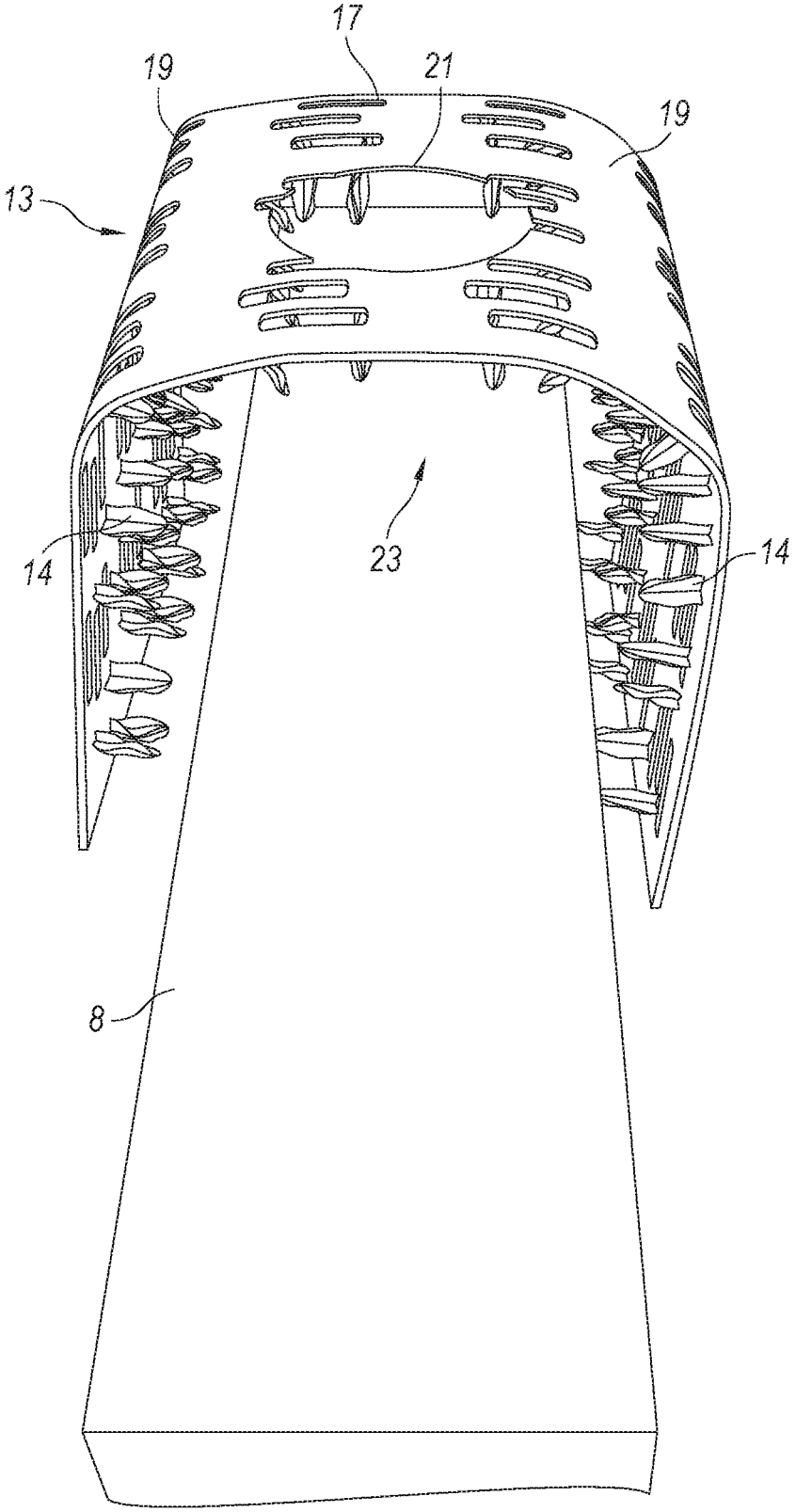
Figure 7C:
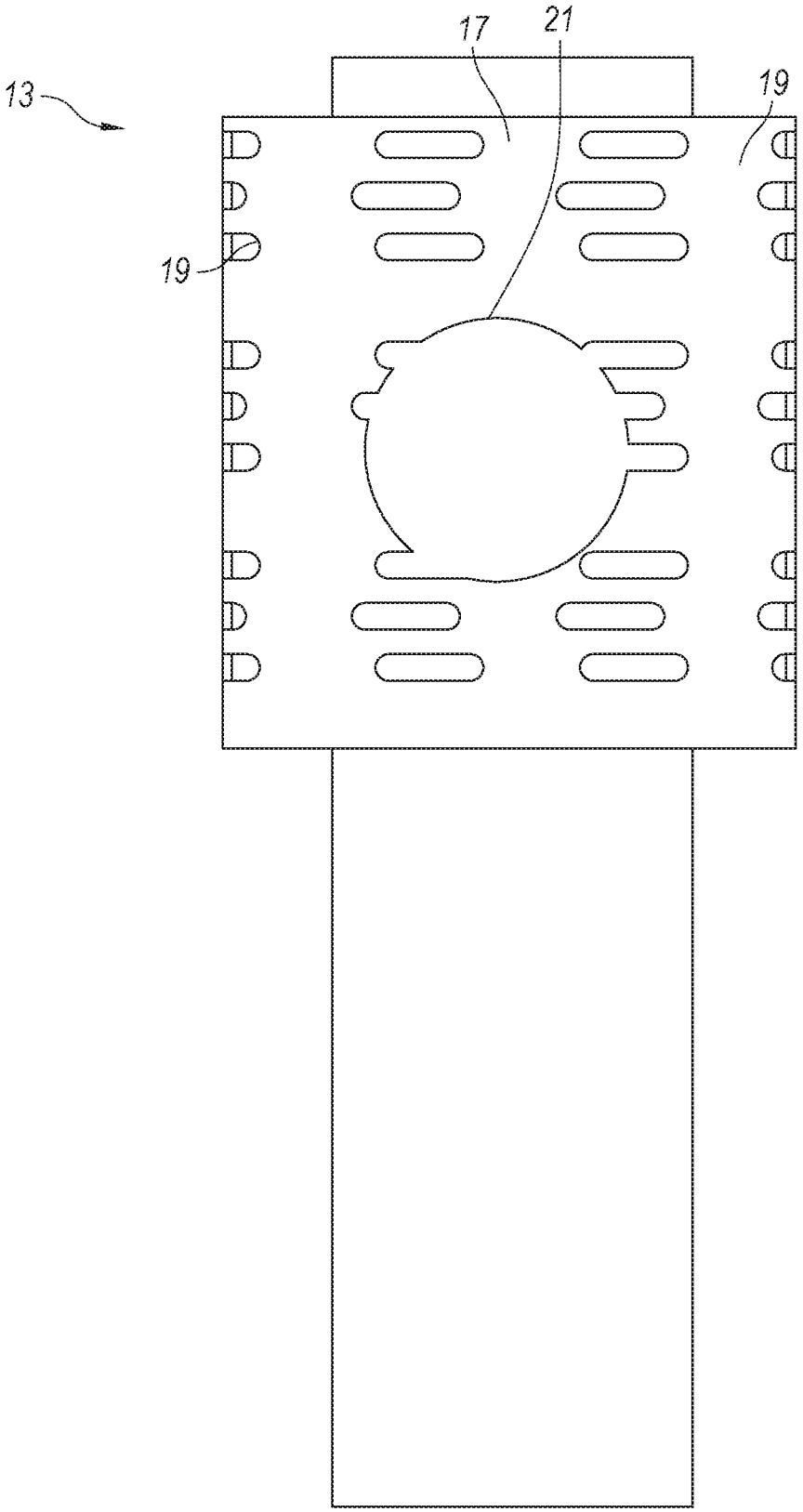
FIG. 7C is a top plan view of the connector bracket of FIG. 7A.
Figure 7D:
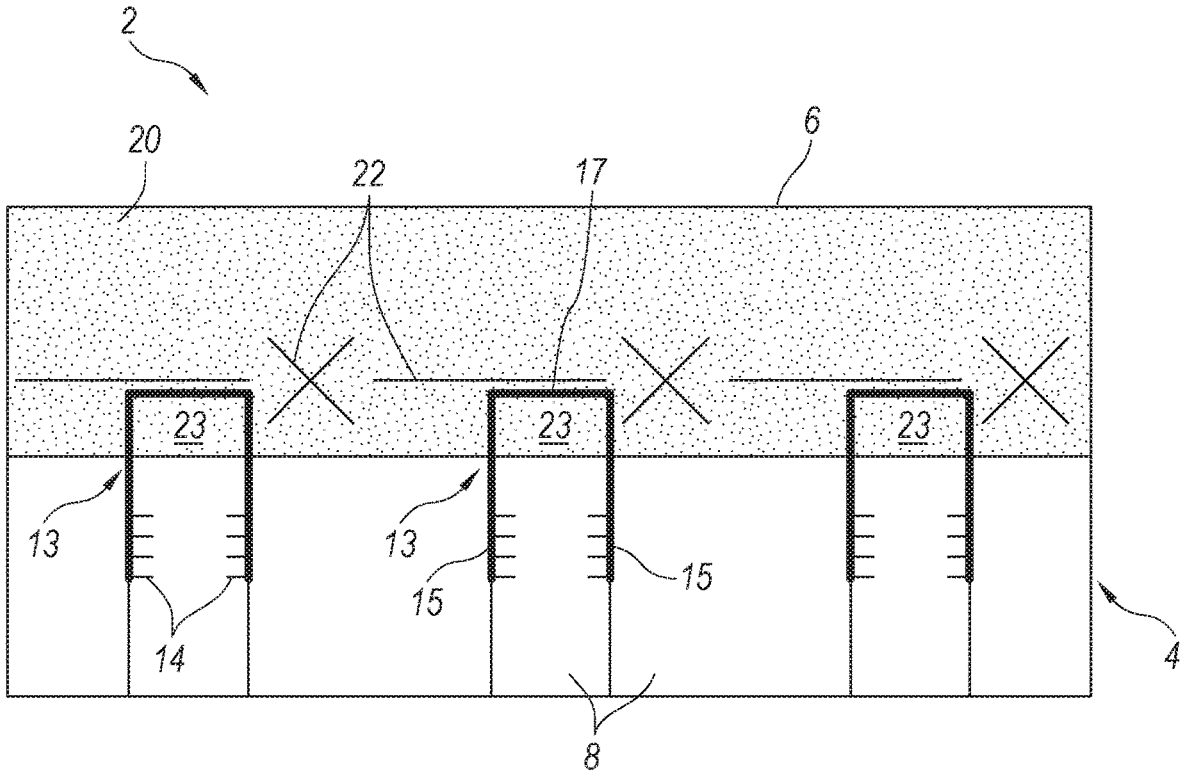
FIG. 7D is cross-sectional side elevation view of a bamboo and concrete composite slab that includes the connector bracket of FIG. 7A.

In the embodiments shown in FIGS. 3-6, the composite slab 2 includes generally planar coupling fixtures that couple to a single side of boards 8. In other embodiments, however, the composite slab 2 can include coupling fixtures having other shapes, such as non-planar or contoured shapes configured to securely connect to one or more sides of a board 8, and with a support portion positionable above the board 8. For example, FIGS. 7A-7C shows an embodiment of a connector bracket 13 formed from a metal plate, and FIG. 7D shows an elevation cross-sectional view of a composite slab 2 that includes the connector brackets 13 attached to respective boards 8. The connector bracket 13 of the illustrated embodiment includes leg portions 15 and a web portion 17 extending between and integrally connected to the leg portions 15 at the bendable corner portions 19. One or more of the leg portions 15 has a plurality of prongs 14 configured to penetrate into the side of the board during installation of the connector bracket 13. In the illustrated embodiment, the opposing leg portions 15 have substantially the same length, and each leg portion 15 includes a plurality of the prongs 14 such that the connector bracket 13 can be securely affixed to the respective board 8 by embedding the prongs 14 into opposing sides of the boards. The connector bracket 13 can be positioned such that the web portion 17 is spaced apart from the top of the board 8 by a selected distance to form a space 23, so that concrete 20 (FIG. 7D) can flow into the space 23 and encapsulate the portion of the connector bracket 13 for an extremely strong and permanent connection between the bamboo platform 4 and the concrete layer 6.

The leg portions 15 can be movable relative to the web portion 17 at the bendable corner portions 19, such that the angle between the leg portions 15 and the web portion 17 can be adjusted to any suitable angle. For example, the leg portions 15 can be configured to form an obtuse angle relative to the web portion 17 to form a truncated "V" shape when the connector bracket 13 is in an un-installed position before being secured to a selected board 8. However, when the connector bracket 13 is affixed to a bamboo board 8, the leg portions 15 can be flexed or bent at the corner portions 19 (e.g., with an automatic clamp system, with a hammer, etc.) until the leg portions 15 are substantially perpendicular to the web portion 17, as shown in FIG. 7B, forming a generally U-shaped bracket. Accordingly, when the connector bracket 13 is in the installed position, the leg portions 15 are substantially parallel to the sides of the board, the prongs 14 penetrate into the sides of the board 8, and the web portion 17 is substantially parallel to and spaced apart from the top surface of the board 8. In general, the leg portions 15 can be movable such that they form any suitable angle with the web portion 17.

The prongs 14 of the illustrated embodiment extend away from the metal plate and have sharp penetrating tips. The prongs can be formed from spikes attached to the inside surface of one or more of the leg portions of the metal plate (e.g., with welds) or can be formed from punched-out portions of the leg portion 15. In representative embodiments, both leg portions 15 include integrally formed prongs 14 extending from the inside surface of the respective leg portion such that, when the connector bracket 13 is affixed to a board 8 with the leg portions 15 substantially perpendicular to the web portion 17, the prongs 14 on the opposing leg portions 15 are embedded in opposing sides of the same bamboo boards 8. The prongs 14 can be arranged in one or more selected patterns. The arrangement of prongs 14 on one of the leg portions 15 can be identical to the prong arrangement on the other leg portion, such that opposing prongs are at least approximately axially aligned with each other. In other embodiments, the opposing prongs 14 may be offset from each other so the opposing prongs are specifically not axially aligned with each other. In the illustrated embodiment, the prongs 14 are at a distal end of the leg portions 15, although the prongs 14 in other embodiments can be formed along some or all of the length of one or more of the leg portions 15.

As indicated above, when the connector bracket 13 is affixed to a selected one of the boards 8, the web portion 17 is parallel to and spaced apart from the top of the board, with the space 23 under the web. The web portion 17 defines a support structure on which reinforcement members 22 (i.e., rebar, reinforcing mesh, or other reinforcement members) can rest, such that the selected reinforcement members 22 are supported atop the brackets 13 and spaced above and apart from the tops of the boards 8. In the illustrated embodiment, the web portion 17 of each connector bracket 13 can include an enlarged hole 21 that provides access into the space 23 from above the web portion 17. The hole 21 can be used to secure the selected reinforcement members 22 atop the web portions 17 before the concrete is poured onto the bamboo or wood platform 4 during formation of the slab. For example, the reinforcement members 22 can be held to the web portions 17 by wires or zip ties that extend through the holes and wrap around an edge portion of the web. Further, when the concrete 20 is poured over the connector bracket 13 (and the supported reinforcement members 22) onto bamboo platform 4 the wet concrete layer 6 can flow through the hole 21 and the open sides of the connector brackets to fully fill the space 23 between the web portion 17 and the boards 8. When the concrete dries and cures, the top portions of the connector brackets 13 (and the reinforcement members 22, when used) are fully encased in the concrete, thereby permanently and securely affixing the concrete 20 to the platform 4.

When constructing a structure that includes composite slab 2, a framework of beams, such a steel beams or other suitable beams, is first erected in the location of the structure. The beams, which may be steel I-beams having flanged top and bottom surfaces, act as a support structure on which the slab 2 is to be attached. After constructing the framework, the bamboo platforms 4 are placed on top of the beams. The bamboo platforms 4, which are typically formed at a separate manufacturing facility prior to installation, are manufactured and shipped with the connector plates 12 already embedded in the boards 8, ensuring that the bamboo platforms 4 are assembled upon arrival at the construction site. Once delivered, some of the bamboo platforms 4 may be modified to ensure that the bamboo platforms 4 perfectly conform to the assembled framework and/or the desired dimensions of the structure and with the connector plates 12 and a selected pattern to support the reinforcement material 18. As such, the bamboo platforms 4 are modular and are capable of being implemented into various building structures without substantial modification to accommodate the specific designs of the structures.

Figure 8:
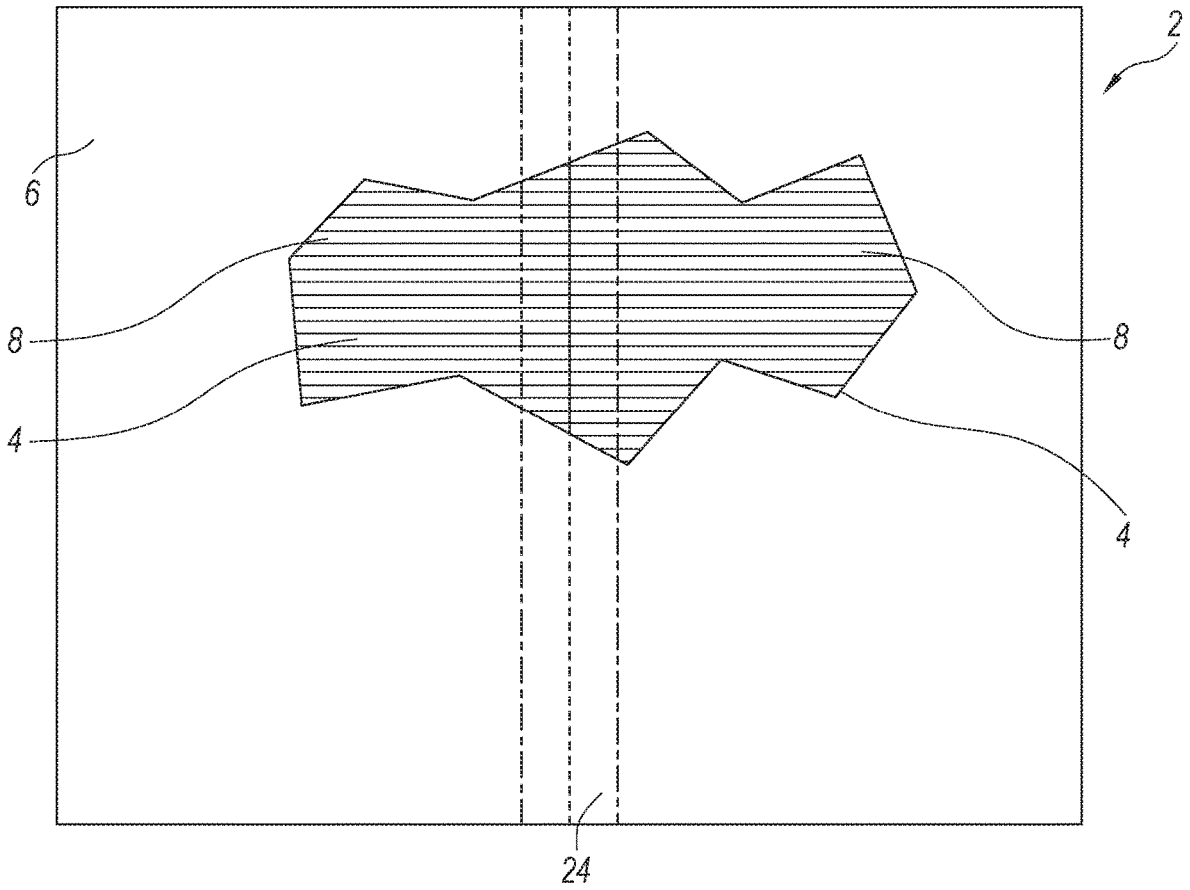
FIG. 8 is a top plan view of the composite slab of FIG. 1.
Figure 9:
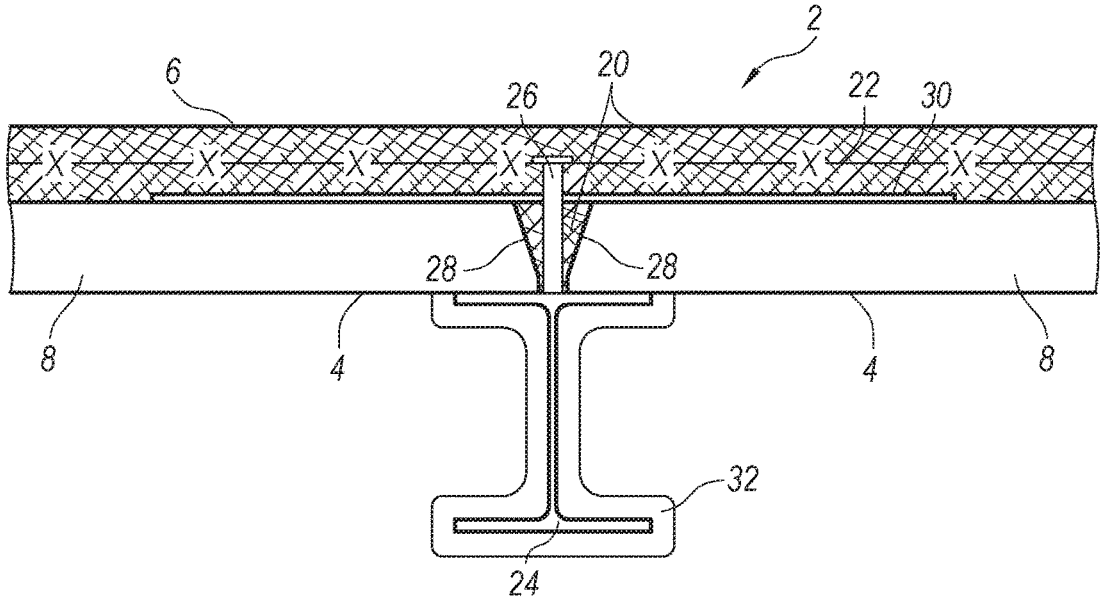
FIG. 9 is a cross-sectional side elevation view of the bamboo and concrete composite slab of FIG. 1.

FIG. 8 shows a top plan view of the composite slab 2 formed from two bamboo platforms 4 positioned over an I-beam 24 and FIG. 9 shows a cross-sectional view of the slab 2 on the I-beam 24. When positioning the bamboo platforms 4 over the framework, the bamboo platforms 4 are positioned such that the ends of the boards 4 overlap with the I-beam 24 such that the end portions of two adjacent bamboo platforms 4 are supported by the same I-beam 24. In this way, a single I-beam 24 can be used to support multiple bamboo platforms 4 in a generally planar orientation. In some embodiments, studs 26 are attached (i.e., welded or otherwise affixed) to the top surface of the I-beam 24 to aid in aligning the bamboo platforms 4 and to act as additional coupling fixtures to further restrict the movement of the concrete relative to the bamboo platforms 4 and the I-beam 24. After positioning the bamboo platforms 4 over the I-beam 24, straps 30 (e.g., Simpson CS16 straps) may be attached to the top surfaces of the two bamboo platforms to ensure that the two boards do not move during the concrete pouring process. The straps 30 may span across the gap between the two adjacent bamboo platforms 4 and restrict movement of the bamboo platforms 4.

After arranging the bamboo platforms 4 onto the framework and ensuring that the bamboo platforms 4 are securely fastened in place, the mesh 22 (such as a steel mesh, other mesh material, or other reinforcing material 18) is arranged over the connector plates 12 and connected to the plates 12 (e.g., using rebar or zip ties). The mesh 22 may be significantly larger than a bamboo platform 4 such that a given piece of mesh 22 can be coupled to the connector plates 12 of multiple bamboo platforms 4. The connector plates 12 are formed in each of the bamboo platforms 4 in a regular pattern or arrangement such that the layout of connector plates 12 in each bamboo platform 4 is identical to the layout of plates 12 in an adjacent bamboo platform 4. Furthermore, the regular arrangement of the connector plates 12 ensures that the mesh 22 accommodates the connector plates 12 of multiple adjacent bamboo platforms 4.

After positioning the bamboo platforms over the I-beam 24 and coupling the mesh 22 to the connector plates 12 of the bamboo platforms 4, concrete 20 is poured over the mesh 22 and atop the laminated bamboo platforms 4 to form the concrete layer 6. The concrete 20 completely covers the top surfaces of the bamboo platforms 4 and surrounds the studs 26 and encases the top portions of the connector plates 12, including associated prongs 14, and the mesh 22, thereby forming and establishing a composite action between the platform and the concrete. In some embodiments, such as the embodiment shown in FIG. 9, the bamboo platforms 4 can have tapered edges 28 that face toward the I-beam 24. When two bamboo platforms are arranged next to each other, the adjacent edges 28 create an opening into which the concrete 20 can flow. In this way, the concrete is able to completely surround the studs 26 and to come into immediate contact with the top of the I-beam 24, thereby further increasing the strength of the coupling between the layer 6 of concrete 20, the I-beam 24, and the bamboo platforms 4. The I-beam 24 may also include a layer of fireproofing material 32 (e.g., Monokote fireproofing compound) applied to at least some of the surfaces of the I-beam 24.

Figure 10:
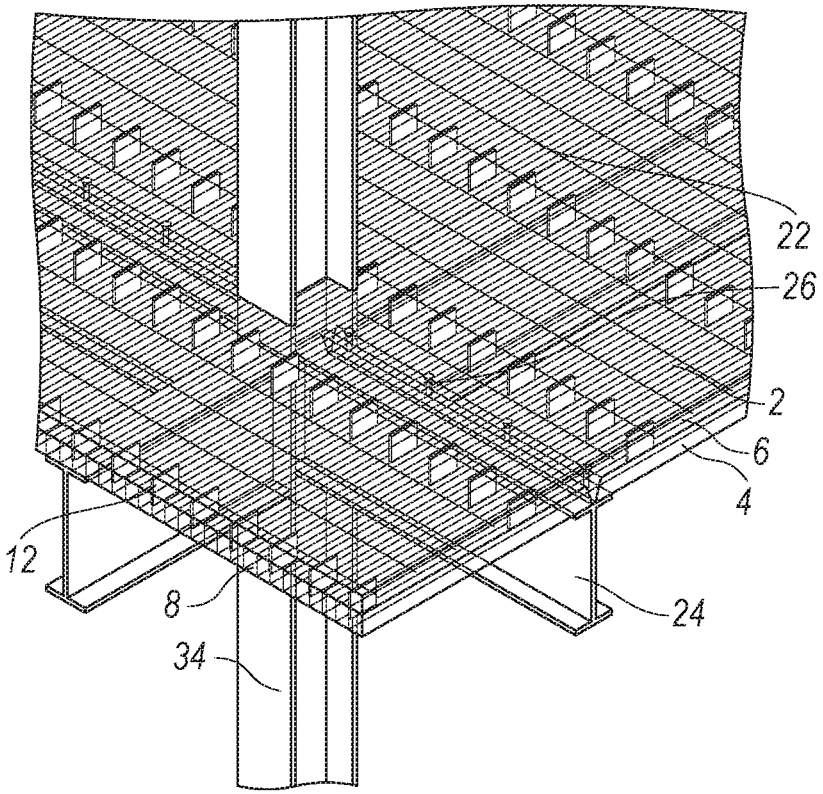
FIG. 10 is an isometric view of the bamboo and concrete composite slab of FIG. 1 supported by an I-beam.

FIGS. 10-16 show arrangements of a bamboo and concrete composite slab arranged over and supported by various support structures. As in the embodiment shown in FIG. 9, FIG. 10 shows an isometric view of the bamboo and concrete composite slab 2 positioned over an I-beam 24, where the slab 2 is formed from bamboo platforms 4 and a layer 6 of concrete 20. The bamboo platforms 4 include a regular arrangement of connector plates 12 inserted between adjacent bamboo boards 8 to form a platform for mesh 22, which reinforces the concrete layer 6. Studs 26 are attached to a top surface of the I-beam 24 and aid in binding the concrete layer 6 to the I-beam 24 and vertical beam 34, which may also be an I-beam, supporting the slab 2 and I-beam 24.

Figure 11:
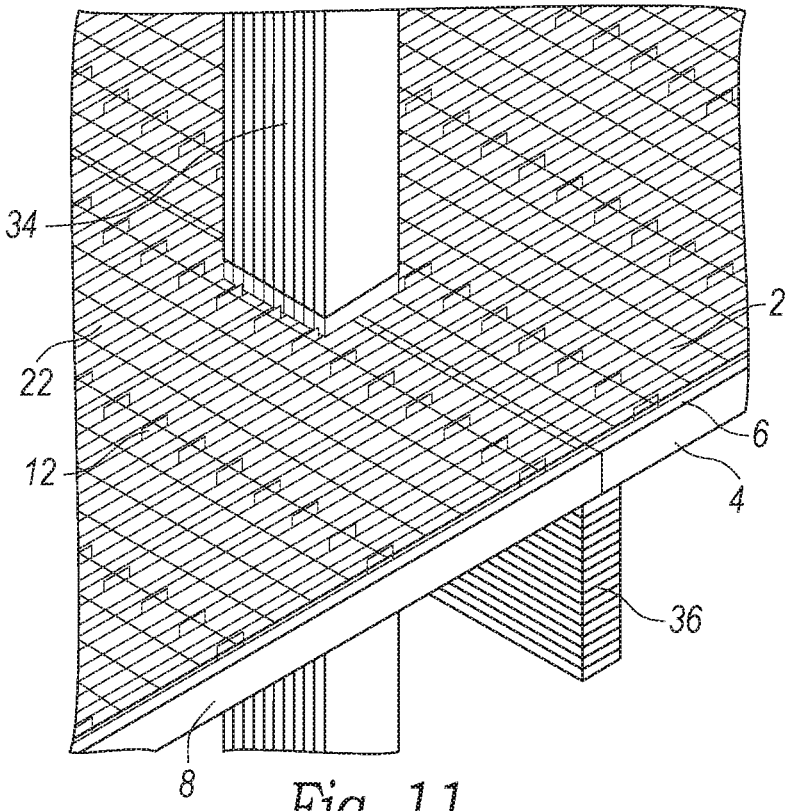
FIG. 11 is an isometric view of the bamboo and concrete composite slab of FIG. 1 supported by a glue laminated timber beam.
Figure 12:
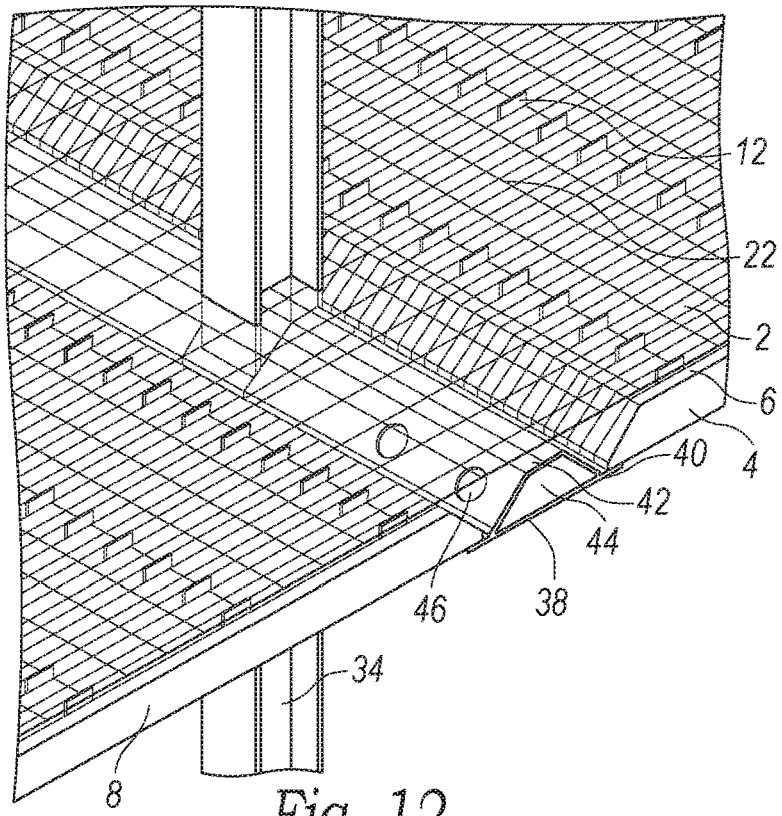
FIG. 12 is an isometric view of the bamboo and concrete composite slab of FIG. 1 supported by a delta beam.

In the embodiment shown in FIG. 11, bamboo and concrete composite slab 2 is arranged on a glue laminated timber (glulam) beam 36. The vertical beam 34 may also be a glulam beam. In the embodiment shown in FIG. 12, a delta beam 38 (e.g., Peikko Group DELTABEAM Composite beam) is used to support the composite slab 2. The delta beam 38 includes a bottom portion 40 on which the bamboo platforms 4 rest and a top portion 42, where the bottom portion 40 and top portion 42 define an opening 44. Holes 46 in the top portion 42 allow access to the opening 44. During construction of the composite slab 2, the bamboo platforms are positioned on the bottom portion 40 and mesh 22 is coupled to the connector plates 12. Concrete is poured over the mesh 22 and the delta beam 38 to form the concrete layer 6. The concrete flows into the opening 44 via the holes 46 to aid in binding the concrete to the beam 38.

Figure 13:
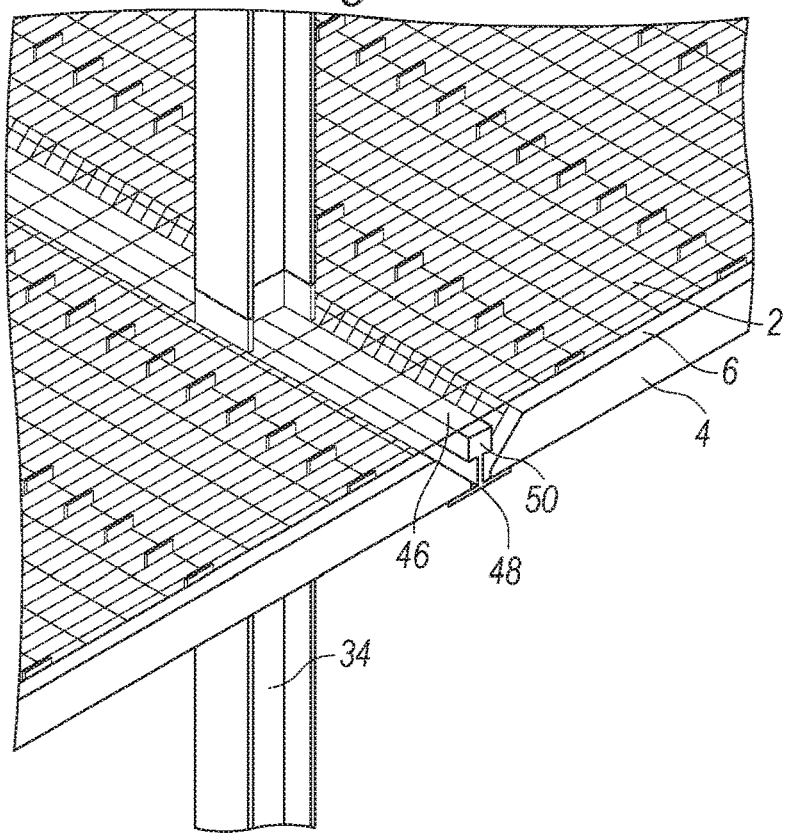
FIG. 13 is an isometric view of the bamboo and concrete composite slab of FIG. 1 supported by an alternative beam.

In the embodiment shown in FIG. 13, the composite beam 2 is supported by a beam 46 having a planar portion 48 and a projecting portion 50. The bamboo platforms 4 are positioned on the planar portion 48 such that the projecting portion 50 is positioned between the ends of two adjacent bamboo platforms 4. Concrete is poured over the bamboo platforms 4 and the projecting portion 50 to form the concrete layer 6. The concrete completely surrounds the projecting portion 50 to aid in binding the concrete to the beam 46.

Figure 14:
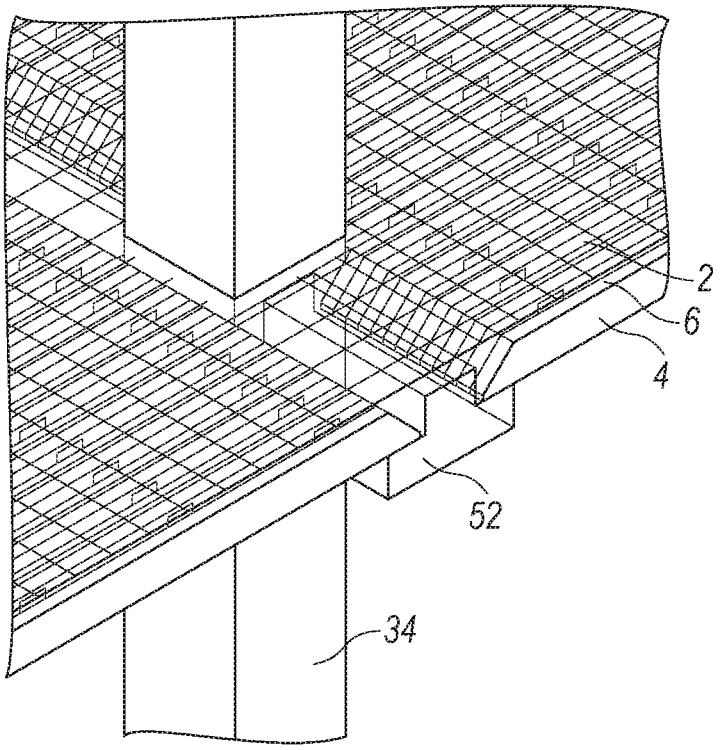
FIG. 14 is an isometric view of the bamboo and concrete composite slab of FIG. 1 supported by a precast concrete beam.

In the embodiment shown in FIG. 14, the composite beam 2 is supported by a precast concrete beam 52. The beam 52 may be formed from reinforced concrete coupled to the vertical beam 34, which may also be formed from concrete. The bamboo platforms 4 are positioned on a flat surface of the precast concrete beam 52 and the concrete layer 6 is formed by pouring concrete over the bamboo platform 4 and the precast concrete beam 52. The precast concrete beam 52 may also include reinforcing material that extends above a top surface of the beam 52 and that is configured to bind to the concrete that forms the concrete layer 6, binding the beam 52 to the concrete layer 6.

Figure 15:
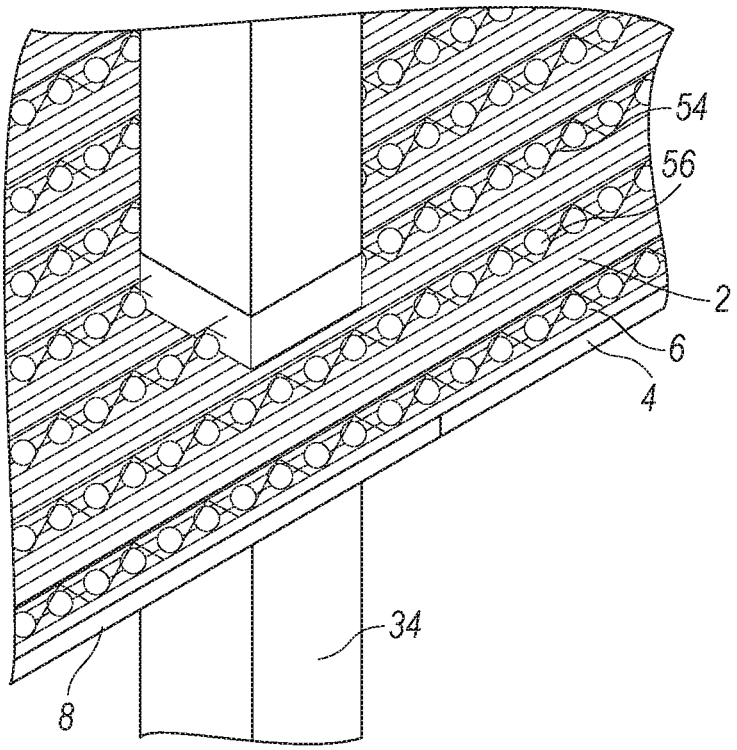
FIG. 15 is an isometric view of a bamboo and concrete composite slab having a ladder reinforcement configured in accordance with an alternative embodiment of the present technology.

In the embodiment shown in FIG. 15, the bamboo and concrete composite slab 2 is formed from bamboo platforms 4 and a layer 6 of concrete formed over the bamboo platforms 4. However, in this embodiment, a plurality of ladder reinforcements 54 are coupled between adjacent boards 8 that form the bamboo platforms 4. The reinforcements 54 include two longitudinal portions and a zig-zag portion that extends between the two longitudinal portions, where the reinforcements 54 are arranged such that the longitudinal portions extend parallel to the length of the boards 8. The reinforcements 54 are partially embedded into the bamboo platforms 4 such that a portion of the reinforcements 54 extend above the boards 8. When forming the concrete layer 6, the portion of the reinforcements 54 that extend above the boards 54 bind with the concrete to increase the strength of the concrete and to aid in binding the bamboo platforms 4 to the concrete layer 6. If desired, a mesh (e.g., steel mesh), rebar, or other reinforcement material may also be used to further improve the mechanical properties of the composite slab 2. To reduce the weight of the composite slab 2, small balls 56 or voids may be coupled to the reinforcements 54. The balls 56 reduce the amount of concrete required to form a slab having a desired height, thereby reducing the weight of the composite slab 2 without substantially affecting the mechanical properties of the slab 2.

From the foregoing, it will be appreciated that specific embodiments of the invention have been described herein for purposes of illustration, but that various modifications may be made without deviating from the scope of the invention. Accordingly, the invention is not limited except as by the appended claims.

We claim:

1. A composite slab, comprising:

a plurality of boards of fibrous material arranged to form a platform;

a concrete layer atop the platform; and a plurality of connectors coupled between the platform and the concrete layer, wherein— each of the plurality of connectors includes first and second portions, the first portion of each of the plurality of connectors positioned below a top surface of the platform and having a first plurality of prongs that are at least partially embedded in at least one of the plurality of boards of fibrous material, the second portion of each of the plurality of connectors is positioned above the platform, and the second portions have reinforcing material coupled thereto spaced apart from the platform and embedded within the concrete layer, wherein the reinforcing material spans at least two of the plurality of connectors;

wherein the plurality of connectors anchors the concrete layer atop the platform.

2. The composite slab of claim 1 wherein the first portion of the connector has a planar portion substantially perpendicular to the top surface of the platform and wherein the first plurality of prongs extend from the planar portion.

3. The composite slab of claim 2 wherein the second portion of the connector has a second plurality of prongs spaced apart from and extending substantially parallel to the top surface.

4. The composite slab of claim 2 wherein the reinforcing material is supported by at least some of the second plurality of prongs.

5. The composite slab of claim 1 wherein the reinforcing material is supported on the second portions of at least some of the connectors.

6. The composite slab of claim 1 wherein the reinforcing material is coupled to at least some of the plurality of connectors by resting on the second portions of the at least some of the plurality of connectors.

7. The composite slab of claim 1 wherein the reinforcing material is secured to the connectors with ties.

8. The composite slab of claim 1 wherein the reinforcing material comprises rebar or mesh.

9. The composite slab of claim 1 wherein the boards of fibrous material comprise bamboo.

10. The composite slab of claim 1 wherein the second portion of each of the plurality of connectors has a horizontal wall substantially parallel to the top surface of the platform and embedded within the concrete layer and wherein the reinforcing material is coupled to the horizontal wall of the second portion.

11. A connector system for a composite slab platform for supporting a reinforced concrete layer atop the platform having boards of fibrous material affixed together and defining a substantially planar top surface supporting the concrete layer, comprising:

a plurality of connectors securable to the plurality of boards, wherein— each of the plurality of connectors includes first and second portions, the first portion of each of the plurality of connectors is configured to be positioned below the planar top surface, the first portion of each of the plurality of connectors has a plurality of first portion prongs that are configured to be at least partially embedded in at least one of the plurality of boards of fibrous material, the second portion of each of the plurality of connectors has a plurality of second portion prongs configured to be encapsulated in concrete of the concrete layer and having a support portion spaced apart from the first portion and configured to support reinforcing material, the reinforcing material spans at least two of the plurality of connectors and is spaced apart from the top surface of the platform, and the second portion prongs and the support portion with the reinforcing material thereon are configured to be embedded within the concrete layer to anchor the concrete layer atop the platform.

12. The connector system of claim 11 wherein the first portion of the connector has a planar portion substantially perpendicular to the top surface of the platform and wherein the plurality of first portion prongs extend from the planar portion.

13. The connector system of claim 12 wherein the plurality of second portion prongs are spaced apart from and extending substantially parallel to the top surface.

14. The connector system of claim 11 wherein a first section of the second portion of the connector is configured to be perpendicular to the top surface, and a second section of the second portion of the connector is not parallel to the first section of the second portion of the connector, and wherein the second section is configured to be spaced apart from the top surface and comprises the support portion.

15. The connector system of claim 11 wherein a first section of the second portion of the connector is configured to be perpendicular to the top surface, and a second section of the second portion of the connector is configured to be substantially parallel to the top surface and spaced apart from the top surface, and the second section comprises the support portion.

16. The connector system of claim 15 wherein the second section of the second portion of the connector is configured to support reinforcing material above the top surface in position to be embedded in the concrete layer.

17. The connector system of claim 11 wherein the second portion of each of the plurality of connectors has a horizontal wall configured to be substantially parallel to the planar top surface of the platform and embedded within the concrete layer and wherein the reinforcing material is supported by the horizontal wall of the second portion.

18. A bamboo composite slab platform for supporting a concreate layer atop the platform, the platform comprising:

a plurality of bamboo composite boards comprising layers of bamboo fibers therein, the bamboo composite boards being affixed together and defining a substantially planar top surface configured to support the concrete layer; and a plurality of connectors, each connector secured to selected ones of the bamboo composite boards, wherein— each of the plurality of connectors includes first and second portions, the first portion of each of the plurality of connectors is positioned between two of the plurality of bamboo composite boards and below the planar top surface and has a plurality of first portion prongs at least partially embedded in at least one of the plurality of bamboo composite boards, the second portion of each of the plurality of connectors has a plurality of second portion prongs and reinforcing material supported by at least some of the plurality of second portion prongs, the reinforcing material is spaced apart from the top surface of the platform, and the second portions and the reinforcing material are configured to be embedded within the concrete layer to anchor the concrete layer atop the platform.

19. The bamboo composite slab platform of claim 18 wherein the first portion of the connector has a planar portion substantially perpendicular to the top surface of the platform and wherein the plurality of first portion prongs extend from the planar portion.

20. The bamboo composite slab platform of claim 18 wherein a first section of the connector's second portion is perpendicular to the top surface, and a second section of the connector's second portion is substantially parallel to the top surface and spaced apart from the top surface.

21. The bamboo composite slab platform of claim 18 wherein the second portion of each of the plurality of connectors has a horizontal wall substantially parallel to the top surface of the platform and embedded within the concrete layer.

* * * * *